US006408856B1

(12) United States Patent
McAdam

(10) Patent No.: US 6,408,856 B1
(45) Date of Patent: Jun. 25, 2002

(54) SMOKABLE FILLER MATERIAL FOR SMOKING ARTICLES

(75) Inventor: Kevin Gerard McAdam, Southampton (GB)

(73) Assignee: British-American Tobacco (Investments) Limited, Staines (GB)

( * ) Notice: Subject to any disclaimer, the term of this patent is extended or adjusted under 35 U.S.C. 154(b) by 0 days.

(21) Appl. No.: 09/142,096

(22) PCT Filed: Mar. 4, 1997

(86) PCT No.: PCT/GB97/00587

§ 371 (c)(1),
(2), (4) Date: Sep. 1, 1998

(87) PCT Pub. No.: WO97/32490

PCT Pub. Date: Sep. 12, 1997

(30) Foreign Application Priority Data

Mar. 7, 1996 (GB) ..... 9605554

(51) Int. Cl.[7] ..... A24B 15/00

(52) U.S. Cl. ..... 131/352; 131/353; 131/354; 131/355; 131/356; 131/357; 131/359; 131/275; 131/276

(58) Field of Search ..... 131/352, 353, 131/354, 355, 356, 357, 359, 275, 276

(56) References Cited

U.S. PATENT DOCUMENTS

| | | | | | |
|---|---|---|---|---|---|
| 3,529,602 | A | * | 9/1970 | Hind | 131/2 |
| 3,894,543 | A | * | 7/1975 | Andersen et al. | 131/2 |
| 3,931,824 | A | * | 1/1976 | Miano et al. | 131/2 |
| 4,008,723 | A | * | 2/1977 | Borthwick et al. | 131/2 |
| 5,540,242 | A | * | 7/1996 | Chao et al. | 131/365 |

FOREIGN PATENT DOCUMENTS

| | | | | |
|---|---|---|---|---|
| GB | 1170858 | * | 11/1969 | A24B/15/00 |
| WO | WO85/02325 | * | 11/1969 | A24D/1/18 |

* cited by examiner

*Primary Examiner*—Stanley S. Silverman
*Assistant Examiner*—Mark Halpern
(74) *Attorney, Agent, or Firm*—Pitney, Hardin, Kipp & Szuch LLP

(57) ABSTRACT

The invention relates to a smokable filler material which attempts to mimic tobacco leaf in its simplest components in order to provide a simpler smoke to the smoker. The smokable filler material comprises aerosol generating means, a substantially non-combustible inorganic filler, a binder and an extract from a flavorful fuel source material. It may also comprise a biopolymer.

19 Claims, No Drawings

SMOKABLE FILLER MATERIAL FOR SMOKING ARTICLES

FIELD OF THE INVENTION

This invention relates to smokable filler material for smoking articles, and in particular to filler material which may not necessarily comprise any tobacco leaf filler material.

BACKGROUND OF THE INVENTION

In the many efforts which have been made to provide alternative smokable filler materials very few, if any, materials have been found which produce a smoke taste and flavour which is acceptable to smokers of conventional tobacco containing products. Therefore, most alternative filler materials have been used in conjunction with cut tobacco leaf or tobacco-containing reconstituted products. However, even in this form the unacceptable taste of these filler materials is noticeable and detracts from smoking pleasure.

U.S. Pat. Nos. 3,931,824 and 3,894,543 and UK Patent Specification No. 1,170,858 disclose tobacco substitute materials comprising inorganic filler and a film forming ingredient, with an optional amount of plasticiser. The aerosol content of these materials makes them undesirable as the sole smokable filler material.

SUMMARY OF THE INVENTION

Some prior art documents are described below. U.S. Pat. No. 4,008,723 discloses a tobacco substitute material containing a minimum amount of organic combustible material and a maximum amount of inorganic filler, and sometimes a thermally degraded cellulose material which comprises substantially carbon after treatment. Glycerol is present as a plasticiser for the smoking composition.

European Patent Application, Publication No. 0 145 424 discloses a tobacco substitute material comprising a base web of cellulosic material and gum binder mixed with hardwood flour, inorganic filler and flavourings. The mixture is predominantly comprised of combustible smoke producing materials and has a low inorganic filler content.

LU 52 376 describes a tobacco substitute material containing free carbon and smoke producing ingredients, such as cellulosic materials, with inorganic materials. The amount of inorganic material is relatively low, whilst the carbon content is high.

Conventional tobacco filler material and reconstituted tobacco products produce complex smoke systems when burnt in smoking articles.

DETAILED DESCRIPTION OF THE INVENTION

It is an object of the present invention to mimic tobacco leaf in its simplest components in order to provide a simpler smoke to the smoker.

We have chosen to do this by excluding or significantly reducing some elements of the biological matrix that produces smoke when tobacco is burnt in a smoking article. The taste and flavour characteristics of the simpler smoke so produced, can be altered or improved by careful choice of the biopolymers and proportions thereof included in the filler material according to the taste and flavour requirements of the smokable filler material.

Other fuel materials, such as the cocoa-based fuel source of our co-pending UK Patent Application No. 9605116.4 filed March 7, 1996 entitled 'Smokable Filler Materials for Smoking Articles', can also be mimicked in the same fashion.

It is also an object of the present invention to provide a smokable filler material with acceptable taste and flavour characteristics for the consumer, which smokable filler material contains little natural tobacco, and preferably no natural tobacco, therein.

It is a further object of the invention to provide a smokable filler material which has acceptable taste and flavour characteristics and is thus suitable for inclusion with tobacco material, if desired, without detracting from the taste and flavour of the natural tobacco products. Alternatively, the filler material may comprise 100% of the smoking article filler material. Ideally the smokable filler material will be of lower cost than tobacco leaf or natural tobacco-containing material.

The present invention provides a smoking article smokable filler material comprising aerosol generating means, a substantially non-combustible inorganic filler, a binder, and an extract of a fuel source material.

The extract from a fuel source material, i.e. parent material, may be derived from any flavourful fuel source material, such as tobacco, cocoa powder or licorice. Mixtures of the extracts may also be used. The extraction method may be an aqueous extraction using solely water or an aqueous extraction using other additives in the extraction process, for example, acids or bases. Organic extraction methods are also suitable, either alone, in combination with aqueous extraction methods as described above, or sequentially, as are supercritical extraction processes, using carbon dioxide ($CO_2$), for example. Detail on all of these extraction processes are not given in detail herein, as these will be known to the skilled man. Some extraction methods are more suitable for removing the flavour components of the fuel source than others. For example, citric acid aqueous extraction is preferred for cocoa powder. The extract may be present as a liquid, or as a dried solid, dried through processes such as spray or freeze drying, for example.

The smoking article smokable filler material may preferably comprise about 2% to about 30% aerosol generating means, about 20% to about 80% inorganic filler material, about 5% to about 25% binder, all by weight of the dry starting materials of the smokable filler material, and about 0.1% to about 30% extract, by weight of the final smokable filler material.

Preferably the amount of aerosol generating means is less than about 15% by weight of the dry materials of the smokable filler.

Preferably the amount of inorganic materials is more than about 40% and more preferably more than about 50% by weight of the dry materials of the smokable filler.

Preferably the amount of binder is less than about 15%, when the binder is not a pectin.

Preferably the amount of extract is less than 30% and more preferably less than 25% by weight of the final sheet material.

Advantageously the smokable filler material further comprises one or more bioploymers commonly found in plant material, such as tobacco. Preferably the biopolymer is a polysaccharide selected from the group consisting of starches, celluloses, pectins, lignin or compounds related to these. The starch may be natural, such as maize, tapioca or potato starch, for example, or modified, dextrinised or pre-gelatinised starches. The cellulose may also be natural cellulose, such as paper fibre; modified celluloses, such as carboxymethyl cellulose and inorganic salts thereof, hydroxypropyl cellulose, hydroxyethyl cellulose or methyl cellulose, for example; cellulose derivatives or associated species, such as lignocellulose, lignin or hemicellulose, for example. Preferably the cellulose is not pre-treated in any way, such as by oxidation, for example. The pectin may be derived from plant or fruit material, for example, citrus pectin, apple pectin, or other pectinaceous material. Preferably the bioploymers are utilised in powder or granular form.

Preferably the biopolymer is present in an amount from 0% to about 70%, and preferably in the range of about 10% to about 60%. Cellulose or starch may be present in an amount from 0% to 45%, preferably not more than 30% and more preferably not more than 20%, by weight of the dry materials of the smokable filler material. Pectin may be present in an amount from 0% to 45%, preferably not more than 40%, more preferably not more than 30% and more preferably about 25%, by weight of the dry materials of the smokable filler.

In addition to the one or more biopolymers listed above there may also be other biopolymers, such as, for example, polyphenolic material in minor amounts, in the smokable filler material. These additional materials may be useful for colouring or flavouring the filler material. Other known colourants may also be used, e.g. caramel.

Carbon, an expansion medium and an organic filler may all be optional additional materials suitable for use in the filler material, depending on the final product characteristics required. For example, a foamed or non-foamed, i.e. expanded, product may additionally, if necessary, comprise an expansion medium, such as starch or hydroxypropyl cellulose, in an appropriate amount, possibly higher than when present as combustible fuel biopolymer. The expansion medium may be present in an amount up to 35%, and the carbon may be present in an amount up to 20%, by weight of the dry materials of the smokable filler material.

The nature of the smoking article wrapper utilised with the smokable filler material will also be a determinant of the composition of the filler material, as well as the permeability of the wrapper material.

Flavourants, casings, such as licorice, or other taste and flavour materials, coffee, tobacco extract or flavourings containing licorice and coffee, for example, may be present in the smokable filler material, as desired. In some cases, the casing material may assist in the combustibility of the smokable filler material, thereby being a fuel material. The filler material may be cased using conventional techniques. Advantageously the smokable filler material of the present invention also comprises one or more of a top flavour typical of those used on cigarette tobacco filler material in order to provide a taste and flavour similar to that of a conventional tobacco-containing cigarette.

Preferably the casings or flavours comprise less than 10% and preferably less than 5% by weight of the non-aqueous materials of the smokable filler.

Plasticisers, such as glycerol, propylene glycol, or other well known plasticisers, may optionally be present at levels at which they do not become the main aerosol component of the smoke.

The smokable filler materials having a higher level of extract therein exhibited better burning characteristics than those with low or no extract therein. It may therefore be advantageous to add burn promoters to some smokable filler materials.

Preferably the smokable filler material according to the invention is a substantially non-natural tobacco material. As used herein, the term substantially non-natural tobacco material should be taken to mean containing less than 5% tobacco leaf material, other than extracts, by weight of the filler, more preferably less than 3% by weight tobacco material, and even more preferably no natural tobacco material therein.

Preferably, the non-combustible inorganic filler is selected from those materials described in our co-pending PCT application. An organic filler may also substitute for a proportion of the inorganic filler, or be used alone as the filler material. The subject matter of our co-pending PCT Application NO. PCT/GB 95/02110 relating to suitable inorganic and organic materials for the present invention is to be considered as incorporated herein by reference thereto. This PCT application will be known herein as our co-pending PCT application. The non-combustible inorganic materials include, such as for example, chalk, perlite, vermiculite, diatomaceous earth, colloidal silica, magnesium oxide, magnesium sulphate or other low density, non-combustible, inorganic filler materials known to those skilled in the art. Organic fillers include inorganic salts of organic acids, polysaccharide material, or, for example, organic binder material, present at a level greater than the level required for that material to act purely as a binder.

Suitable binder materials for the present invention include the well known cellulosic or cellulosic derivative binders, alginic or pectinaceous binders, all of which are described in our co-pending PCT application, particularly in relation to the non-combustible wrapper thereof. The polysaccharide materials selected as the fuel material may, in the proportions chosen, have sufficient binding properties, such that a further binder may not be required. Should a further binder be required it may be an organic binder, for example, cellulose derivatives, such as sodium carboxymethyl cellulose, methyl cellulose, hydroxypropyl cellulose, hydroxyethyl cellulose or cellulose ethers, alginic binders including soluble alginates such as ammonium alginate, sodium alginate, sodium calcium alginate, calcium ammonium alginate, potassium alginate, magnesium alginate, triethanol-amine alginate and propylene glycol alginate, or insoluble alginates which can be rendered soluble by the addition of solubilising agents, such as ammonium hydroxide. Examples of these include aluminium, copper, zinc and silver alginates. Alginates which are initially soluble but which, during processing, undergo treatment to render them insoluble in the final product may also be used, e.g. sodium alginate going to calcium alginate. Other organic binders include gums such as gum arabic, gum ghatti, gum tragacanth, Karaya, locust bean, acacia, guar, quince seed or xantham gums, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Inorganic non-combustible binders, such as potassium silicate, magnesium oxide in combination with potassium silicate, or some cements, for example, and mixtures thereof, may also be used, usually in the alternative. Combinations of all of the above may also be used.

The aerosol generating source preferably comprises aerosol forming means, such as glycerol and/or other aerosol forming compounds illustrated in our co-pending PCT application. These include polyhydric alcohols, propylene glycol and triethylene glycol, esters such as triethyl citrate, triacetin or triethyl glycol diacetate (TEGDA), or high boiling point hydrocarbons. Other suitable aerosol forming means will be known to those skilled in the art.

As indicated above, the smokable filler material may suitably be an extruded material, which extruded material may be a foamed or non-foamed material. Suitable expansion mediums or foaming means are described in our co-pending PCT application, the subject matter thereof in relation to expansion mediums being incorporated herein by reference thereto. Suitable expansion mediums include starch, pullulan or other polysaccharides, including cellulose derivatives, solid foaming agents, inorganic salts and organic acids providing in situ gaseous agents, organic gaseous agents, inorganic gaseous agents and volatile liquid foaming agents. Water is most commonly the preferred volatile expansion agent for such expansion systems. Alternative expansion agents are well known. The extruded material may be rods, strands, filaments or sheet material which is then cut to provide filler material. Alternatively the smokable filler material may be cast as a sheet using known conventional band casting or paper making techniques. Entwining or twisting of the strands or filaments may be desirable to provide air passages, if the extruded material does not allow the drawing of air or smoke therealong. Other downstream processing techniques may also be used to improve pressure drop. Various extruded forms are described in our co-pending PCT application and should be taken to be incorporated herein by reference thereto.

The smokable filler material may advantageously also comprise carbon material, activated or not. Preferably the carbon material is powdered or granular carbon material.

Plasticisers, such as glycerol, propylene glycol, or other well known plasticisers, may optionally be present at levels at which they do not become the main aerosol component of the smoke.

Smoking article filler material according to the invention may be used with conventional tobacco filler material or other tobacco substitute material as a diluent or a means of lowering the static peak burning temperature of the cigarette rod. It may also be used alone as the smoking article filler material.

Smoking article filler material according to the invention is suitable for use in conventional paper wrapped smoking articles, as well as in the alternative smoking article wrapper described in our co-pending PCT application. The subject matter of our PCT application relating to smoking article wrappers is incorporated herein by reference. The smoking article filler material is also suitable for use in the alternative smoking articles described by R. J. Reynolds in their patent applications deriving from U.S. Ser. No. 650,604 filed Sep. 14, 1984 and U.S. Ser. No. 684,537 filed Dec. 21, 1984, as either the aerosol generating means or the solid fuel element in those devices known as 'Premier'-type devices. Indeed, it may also be suitable in other aerosol delivery articles. The present material may partially or fully replace the materials described in those US specifications, and others deriving therefrom. The filler material of the present invention may also be known as a fuel source material.

The invention also provides a smoking article comprising a wrapper enwrapping a rod of smokable filler material as described above.

Advantageously the wrapper is a substantially non-combustible wrapper such as that described in our co-pending PCT application. The subject matter thereof relating to the substantially non-combustible wrapper is to be considered as incorporated herein by reference thereto. In summary, the wrapper comprises predominantly non-combustible, particulate, inorganic filler material, a binder, and/or a plasticiser, and optionally a small amount of fibre. These materials have all been described above.

Preferably the substantially non-combustible wrapper is comprised of predominantly non-combustible inorganic filler material. The term 'predominantly'as used herein means at least about 65% and usually 70%. The inorganic filler material advantageously yields very little or substantially no visible sidestream smoke when the smoking article is lit. Preferably the non-combustible wrapper comprises at least 80%, and more preferably at least 90% inorganic filler material by weight of the wrapper.

The non-combustible wrapper may comprise a small amount of cellulosic fibre material. Preferably the fibre material comprises less than 10%, more preferably less than 5%, and even more preferably less than 2% by weight of the non-combustible wrapper. Most advantageously the fibre material is not present in the wrapper.

Preferably the wrapper comprises a binder and/or a plasticiser. These components may be present at up to 30% by weight of the wrapper. Advantageously the binder is not present at more than 25% by weight of the wrapper. The exact proportions will depend on the taste characteristics, acceptable visible sidestream smoke emission and strength of the desired product, and the processing techniques used. The binder may be present at about 8–10% by weight of the wrapper, although it may be present at about 5% or less by weight of the wrapper.

The wrapper, although not giving much, if any, visible sidestream smoke, does produce an ash of an acceptable colour and quality. The smoking article also has a visible burn line which advances along the article and enables the smoker to determine whether the article is alight and to monitor the smoking process. The visible burn line may be formed as a result of burning the organic binder. Alternatively, colour changing compounds can be included in the wrapper composition. Colourants which give the wrapper an other than white colour may also be included. These colourants may also change colour as heating occurs, providing a visible burn line, e.g. $CuSO_4.5H_2O$.

The nature of the binder selected will also determine the permeability of the outer wrapper. Binders, such as sodium carboxymethyl cellulose and propylene glycol alginate, have been found to be particularly effective at producing an outer wrapper sufficiently permeable to sustain combustion of the fuel source within the wrapper. The latter binder gave the more permeable outer for the same outer wrapper composition. Hydration time of some binders can play a part in determining the efficacy of the binders. Conventionally understood strong binders such as hydroxypropyl cellulose can be used at lower levels to increase the wrapper permeability but this has to be balanced against the strength of the wrapper.

The plasticiser may be present in the wrapper at up to 20% by weight thereof. The plasticiser is preferably present at about 10% or less, preferably 5% or less, by weight of the wrapper. The plasticiser may be glycerol, propylene glycol, or low melting point fats or oils for example. Depending on the method of production selected for the wrappers, the plasticiser may be absent from the wrapper composition. The plasticiser helps in the drying stages of the wrapper to prevent shape distortion, particularly if direct heat, e.g. hot air, is the drying medium. The amount of plasticiser, binder or other organic filler material will affect the appearance of the burn line, i.e. the burn line width, and the amount of visible sidestream of the article. Preferably the width of the burn line is not greater than 10 mm, is preferably not more than 5 mm and more preferably is between 2–3 mm in width. The width of the burn line depends on the composition of the burnable material in the article.

In order that the invention may be easily understood and readily carried into effect the following examples were performed to illustrate the invention and aspects thereof.

EXAMPLE 1

Various compositions of smokable filler material were made according to the compositions given in Table 1. The fuel source or parent material from which the extract was taken was tobacco. Two tobacco blends were extracted. The first was a US-blended, cased and flavoured tobacco blend and the second was an unflavoured Virginia tobacco. The extraction method consisted of adding 400 ml boiling water to an amount of tobacco labelled A, B and C in Table 1, and left for approximately 1 hour. The extraction liquid was separated from the tobacco solids and the volume made up to 400 ml to compensate for water still absorbed by the tobacco. The extraction liquid was used to hydrate the binder in the amounts described in Table 1. In Table 1, A means 30 g of US blended tobacco, B means 90 g of US blended tobacco and C means 30 g of Virginia tobacco, each as described above.

The dry components were blended together before hydration as described above to provide a paste. For each sample 100 g of component materials, other than the extract or water, were used. The paste was then inserted into a syringe having a circular nozzle of 1 mm diameter and strands of filler material were extruded onto plastic sheet. The strands were left to dry in air at room temperature overnight.

In order to assess the smoke deliveries of smoking articles containing smokable filler according to the present invention, strands of filler material were inserted into a substantially non-combustible, pre-extruded wrapper. Sufficient strands of filler material were used to provide a well-packed smoking article. In practice, 15–20 strands of 1 mm diameter can be inserted into a wrapper having an internal diameter of about 7.0 mm.

The substantially non-combustible wrapper was made from log sodium alginate (Kelvis grade—supplied by Kelco International) hydrated in 200 ml water while being shred in a Crypto Fearless food mixer for 1 hour, 90 g perlite (PO5 grade), which was previously ground to a particle size of $\leqq 120\ \mu m$ is added to the binder/water mixture with constant stirring for a further hour. The paste was extruded through a torpedo die of a ram extruder to give a tube in excess of 69 mm length and 0.5 mm wall thickness. The tube was extruded into a 1 liter of 1M calcium chloride (aqueous) solution, then removed after 10 seconds, allowed to dry in air overnight at room temperature, cut to length and a filter attached. Strands of extruded filler material were inserted into the wrapper. About 18 strands could be inserted.

The smoke data generated from cigarettes made from the so-filled wrappers when attached to a filter element of fibrous cellulose acetate tow of 27 mm length having a pressure drop of about 70 mm WG is shown in Table 2. The smoking articles were smoked under standard machine smoking conditions of a 35 $cm^3$ puff of 2 seconds duration every minute to a butt length, including filter, of 35 mm length.

EXAMPLE 2

A similar process was repeated using cocoa powder as the parent material from which an extract was derived. In this instance though, the water used for the extraction process contained citric acid at a concentration of 1 Molar. It was found that use of citric acid as an additive in the aqueous extraction process increased the yield of flavour components released during extraction.

The compositions of the mixtures used to produce strands are given in Table 3. Again, for each sample 100 g of component materials, other than the extract or water, were used. The strands produced containing cocoa extract were used as the filler material for a smoking article comprising an outer wrapper identical to that described in Example 1 and a filter tip.

The smoke data generated from smoking these smoking articles is given in Table 4.

The outer weight given in Tables 2 and 4 is the average of all samples made.

In Example 3 fuel materials were prepared by mixing the solid particulate ingredients in a food blender. The liquid components were added while the solid components were being rapidly stirred, in order to ensure thorough mixing. After all the water had been added the mixture was stirred for 30 minutes to allow the binder sufficient time for complete hydration. The resulting slurry was cast onto a heated stainless steel rotating drum which was maintained at a temperature of 105° C. The slurry was introduced onto the drum through a slit of 0.75 mm width. The dried sheet material was collected from the drum in sheet form conditioned at 60% relative humidity overnight and shredded through an office shredder. The resulting strands were similar in size to tobacco strands. The samples were then assembled into paper-wrapped cigarettes 84 mm long, with a 27 mm cellulose acetate filter and 32 mm tipping. The cigarettes were smoked under standard ISO machine smoking conditions in which a 35 $cm^3$ puff of 2 seconds duration is taken every minute to a 35 mm butt length. Smoke deliveries were obtained gravimetrically using a Cambridge filter pad.

EXAMPLE 3

In order to look at formulations with no polysaccharide, reduced polysaccharide content compared with the earlier examples and the effect of casings on the fuel mixture, the following formulations outlined in Table 5 were prepared. 150 g of tobacco was extracted with boiling water by adding 1.7 liters of boiling water thereto and leaving to cool overnight. One liter of the extract was taken the following morning and used to hydrate the mixture (200 ml in each mixture). The formulations and smoke data are given in Table 5.

The smoke data shows how the wet tar (particulate matter water and nicotine free) is considerably reduced with these particular formulations. Similar reductions and variations in smoke delivery can be obtained with similar formulations as would be clear to a skilled man.

TABLE 1

COMPOSITION OF FILLER MATERIAL CONTAINING TOBACCO EXTRACT

| Sample Number | Starch % | Glycerol % | Cellulose % | Pectin % | PGA % | Tobacco Extract | Chalk % |
|---|---|---|---|---|---|---|---|
| 1 | 10 | 10 | 10 | 10 | 10 | 400 ml of A | 50 |
| 2 | 30 | 10 | 10 | 10 | 10 | 400 ml of A | 30 |
| 3 | 0 | 10 | 10 | 10 | 10 | 400 ml of A | 60 |
| 4 | 10 | 10 | 30 | 10 | 10 | 400 ml of A | 30 |
| 5 | 10 | 10 | 0 | 10 | 10 | 400 ml of A | 60 |
| 6 | 10 | 10 | 10 | 30 | 10 | 400 ml of A + 70 ml water | 30 |
| 7 | 10 | 10 | 10 | 0 | 10 | 300 ml of A | 60 |
| 8 | 10 | 10 | 10 | 10 | 10 | No extract + 400 ml water | 50 |
| 9 | 10 | 10 | 10 | 10 | 10 | 400 ml of B | 50 |
| 10 | 10 | 10 | 10 | 10 | 10 | 400 ml of C | 50 |

TABLE 2

SMOKING DATA FROM SAMPLES OF TABLE 1

| Sample | Outer Weight (g) | Fuel Weight (g) | TPM yield (mg) | Puff number |
|---|---|---|---|---|
| 1 | 0.3738 | 0.7436 | 8.2 | 17 |
| 2 | 0.3738 | 0.7140 | 8.2 | 17 |
| 3 | 0.3738 | 0.8165 | 4.7 | 16 |
| 4 | 0.3738 | 0.9050 | 8.9 | 18 |
| 5 | 0.3738 | 0.6753 | 6.8 | 16 |
| 6 | 0.3738 | 0.7594 | 7.7 | 17 |
| 7 | 0.3738 | 0.8097 | 5.5 | 13 |
| 8 | 0.3738 | 0.7625 | 8.9 | 17 |
| 9 | 0.3738 | 0.7743 | 8.0 | 13 |
| 10 | 0.3738 | 0.7035 | 12.1 | 13 |

TABLE 3

COMPOSITIONS OF FILLER MATERIAL CONTAINING COCOA EXTRACT

| Sample Number | Starch % | Glycerol % | Cellulose % | Pectin % | Cocoa Extract | Chalk % |
|---|---|---|---|---|---|---|
| 11 | 10 | 10 | 10 | 20 | 270 ml of A | 50 |
| 12 | 30 | 10 | 10 | 20 | 270 ml of A | 30 |
| 13 | 0 | 10 | 10 | 20 | 270 ml of A | 60 |
| 14 | 10 | 10 | 30 | 20 | 270 ml of A | 30 |
| 15 | 10 | 10 | 0 | 20 | 270 ml of A | 60 |
| 16 | 10 | 10 | 10 | 40 | 270 ml of A | 30 |
| 17 | 10 | 10 | 10 | 10 | 155 ml of A | 60 |
| 18 | 10 | 10 | 10 | 20 | No extract + 270 ml of water | 50 |
| 19 | 10 | 10 | 10 | 20 | 270 ml of B | 50 |
| 20 | 10 | 10 | 10 | 20 | 270 ml of C | 50 |

TABLE 4

SMOKING DATA FROM THE SAMPLES OF TABLE 3

| Sample | Outer Weight (g) | Fuel Weight (g) | TPM yield (mg) | Puff number |
|---|---|---|---|---|
| 11 | 0.3738 | 0.7219 | 3.5 | 16 |
| 12 | 0.3738 | 1.0702 | 21.9 | 22 |
| 13 | 0.3738 | 1.0451 | 8.5 | 16 |

TABLE 4-continued

SMOKING DATA FROM THE SAMPLES OF TABLE 3

| Sample | Outer Weight (g) | Fuel Weight (g) | TPM yield (mg) | Puff number |
|---|---|---|---|---|
| 14 | 0.3738 | 0.9936 | 9.6 | 16 |
| 15 | 0.3738 | 0.9238 | 8.5 | 13 |
| 16 | 0.3738 | 0.467 | 2.7 | 10 |
| 17 | 0.3738 | 0.9761 | 8.6 | 20 |
| 18 | 0.3738 | 0.7547 | 10.1 | 18 |
| 19 | 0.3738 | 1.0260 | 11.5 | 13 |
| 20 | 0.3738 | 1.3084 | 14.7 | 17 |

TABLE 5

| | Sample No. | | | | |
|---|---|---|---|---|---|
| | 37 | 38 | 39 | 40 | 41 |
| Material (g) | | | | | |
| Starch | — | 10 | — | — | 10 |
| Pectin | — | — | — | 10 | 10 |
| Cellulose | — | — | 10 | — | 10 |
| Glycerol | 10 | 10 | 10 | 10 | 10 |

TABLE 5-continued

| | Sample No. | | | | |
|---|---|---|---|---|---|
| | 37 | 38 | 39 | 40 | 41 |
| PGA | 10 | 10 | 10 | 10 | 10 |
| Chalk | 80 | 70 | 70 | 70 | 40 |
| Water (ml) | 250 | 250 | 250 | 250 | 250 |
| Cocoa | — | — | — | — | 4 |
| Licorice | — | — | — | — | 3 |
| Sugar | — | — | — | — | 3 |
| Liquid tobacco extract (ml) | 200 | 200 | 200 | 200 | 200 |
| Smoke Data | | | | | |
| Fuel weight in cigarette (g) | 1.08 | 1.08 | 1.00 | 0.88 | 0.74 |
| Puff Number | 8 | 6 | 7 | 5 | 6 |
| Smoke Delivery (wet tar) (mg) | 6.5 | 6.4 | 6.7 | 5.1 | 9.5 |

What is claimed is:

1. A smoking article smokable filler material comprising aerosol generating means, a substantially non-combustible inorganic filler, a binder, and an extract of a fuel source, the smokable filler material comprising dry starting materials including about 10% to about 30% aerosol generating means, about 20% to about 80% inorganic filler material, and about 5% to about 25% pectinaceous binder, all by weight of the dry starting materials of the smokable filler, and the smokable filler further comprising 0.1% to about 30% extract, by weight of the smokable filler material, the filler material further comprising more than one plant polysaccharide biopolymer.

2. A smoking article smokable filler material comprising aerosol generating means, a substantially non-combustible inorganic filler, a binder, and an extract of a fuel source, the smokable filler comprising about 10% to about 301% aerosol generating means, about 20% to about 80% inorganic filler material, less than about 15% binder, said binder being other than a pectinaceous binder, all by weight of the dry starting materials of the smokable filler, and about 0.1% to about 30% extract, by weight of the final smokable filler material, the filler material further comprising two or more plant polysaccharide biopolymers.

3. A smokable filler mate al according to any one of claim 1 or claim 2, wherein the extract from the fuel source is from any flavourful fuel material.

4. A smokable filler material according to any one of claim 1 or claim 2, wherein carbon, an expansion medium and an organic filler material are optional additional materials in the smokable filler material.

5. A smokable filler material according to claim 4, wherein the expansion medium is selected from the group consisting of starch, pullulan or other polysaccharides, including cellulose derivatives, solid foaming agents, inorganic salts and organic acids providing in situ gaseous agents, organic gaseous agents, inorganic gaseous agents and volatile liquid foaming agents.

6. A smokable filler material according to any one of claim 1 or claim 2, wherein the non-combustible, inorganic material is selected from a group consisting of chalk, perlite, vermiculite, diatomaceous earth, colloidal silica, magnesium oxide, magnesium sulphate and low density, non-combustible, inorganic filler materials having a density within the range of about 0.1–3.97 g/cm$^3$.

7. A smokable filler material according to any one of claim 1 or claim 2, wherein the aerosol generating means comprises aerosol forming means selected from a group consisting of polyhydric alcohols, propylene glycol, triethylene glycol, glycerol, esters and high boiling point hydrocarbons.

8. A smoking article comprising a wrapper enwrapping a rod of smokable filler material according to any one of claim 1 or claim 2, said wrapper being a substantially non-combustible wrapper comprising predominantly non-combustible inorganic filler material, a binder and a plasticiser, and optionally a small amount of fibre.

9. A smoking article according to claim 8, wherein the non-combustible, inorganic filler material of the wrapper is particulate.

10. A smoking article comprising a wrapper enwrapping a rod of smokable filler material according to any one of claim 1 or claim 2, said wrapper being a substantially non-combustible wrapper comprising predominantly non-combustible inorganic filler material, a binder, or a plasticiser, and optionally a small count of fibre.

11. A smokable article smokable filler material according to claim 1, wherein the more than one plant polysaccharide includes cellulose, the cellulose is not pre-treated and is present at 20% or less by weight of the smokable filler material.

12. A smokable filler material according to claim 2, wherein the cellulose is not oxidised cellulose or cellulosic material.

13. A smokable filler material according to claim 2, wherein the polysaccharide is selected from a group consisting of starches, cellulose, pectins, lignins, lignocelluloses and hemicelluloses.

14. A smokable filler material according to claim 13, wherein the starch is selected from a group consisting of natural starches, modified starch, dextrinised starch and pre-gelatinised starch; the cellulose is selected from a group consisting of natural cellulose, carboxymethyl cellulose and inorganic salts thereof, hydroxypropyl cellulose, hydroxyethyl cellulose, methyl cellulose and other modified celluloses, cellulose derivatives, lignocellulose lignin and hemicellulose; and the pectin is derived from a plant or fruit material.

15. A smokable filler material according to claim 4, wherein said natural cellulose is paper fibre.

16. A smokable filler material according to claim 14, wherein said natural starches are selected from a group consisting of maize starches, tapioca starches and potato starches.

17. A smokable filler material according to claim 2, wherein the plant polysaccharide biopolymer is present in an amount of from 0% to about 70% by weight of the dry materials of the smokable filler.

18. A smokable filler material according to claim 2, wherein the binder is either an organic binder selected from a group consisting of cellulosic and cellulosic derivative binders, alginic binders and an inorganic binder.

19. A smokable filler material according to claim 18, wherein said inorganic binder is selected from a group consisting of potassium silicate, magnesium oxide in combination with potassium silicate and cement, and mixtures thereof.

* * * * *